US005415263A

United States Patent [19]

Bessette

[11] Patent Number: 5,415,263

[45] Date of Patent: May 16, 1995

[54] SAFETY SWITCH ASSEMBLY

[75] Inventor: Brian P. Bessette, Colchester, Vt.

[73] Assignee: Custom Controls, Inc., Williston, Vt.

[21] Appl. No.: 85,725

[22] Filed: Jul. 6, 1993

Related U.S. Application Data

[63] Continuation-in-part of Ser. No. 891,195, Jun. 1, 1992, abandoned.

[51] Int. Cl.[6] ..... H01H 3/02; H01H 35/32

[52] U.S. Cl. ..... 192/130; 192/129 A; 192/129 B; 200/61.85; 200/81 H; 307/144

[58] Field of Search ..... 192/129 R, 129 A, 129 B; 307/144; 200/61.85, 81 H

[56] References Cited

U.S. PATENT DOCUMENTS

| | | | |
|---|---|---|---|
| 2,794,523 | 6/1957 | Cortelli et al. | 192/129 A X |
| 3,986,281 | 10/1976 | Darwin | 192/130 X |
| 4,487,305 | 12/1984 | Wagner | 192/129 A |
| 4,647,738 | 3/1987 | Diamond | 200/81 H |
| 4,839,533 | 6/1989 | Aga | 192/129 A X |

*Primary Examiner*—Richard M. Lorence
*Attorney, Agent, or Firm*—Thomas N. Neiman

[57] ABSTRACT

The safety switch assembly is designed to provide a switch assembly to a tool, such as a meat slicer, in order to prevent the operation of the tool without manually holding the secondary switch and the depression of a button. The assembly contains a control box having a ground fault interrupter/on-off switch, signal device a pneumatic switch power receptacle and a control circuit. A safety handle is installed on the tool and the handle has an actuation button and a safety button, which functions as a four way valve, installed in series, and connected to an air tube that connects the safety handle to the control box pneumatic air switch. The operation of the tool requires that power be supplied to the control box. When the individual depresses the safety and squeezes the button on the handle, the control box provides power to the tool itself.

5 Claims, 2 Drawing Sheets

SAFETY SWITCH ASSEMBLY

This is a continuation-in part application of Ser. No. 07/891,195 filed on 1 June 1992, now abandoned.

BACKGROUND OF THE INVENTION

This invention pertains to power tools, and, in particular, to a safety switch assembly that is designed to be used with power tools such as meat slicers, and the like, in order to protect the operator from the tool being activated accidentally when the hands of the user are not in the proper position to keep it from being injured.

There are a number of safety switches on the market today. Most of them are small switches on the handle of a power tool which allows the user to physically squeeze the power switch or trigger. In other words, the power switch or trigger cannot be squeezed until the safety switch is pressed in.

Clearly, it is desirable for an apparatus of this type to be very lightweight and flexible. At the same time, the apparatus should be easy to install and be extremely simple to attach to power tool, such as a meat slicer, and at the same time be very effective. It is the nature of a meat slicer that requires the user to place the meat against the slicer knife. One hand slides the carriage back and forth to cut the meat and rests on the tool handle. The other hand is used to catch the product being sliced. An object of this invention is to provide an assembly that has an ease of manufacture and ease of assembly. It is another object of this invention to teach an assembly that will require the user to have his or her hands in the proper position to avoid injury when using the power tool. It is an object of this invention to set forth an improved safety switch assembly which avoids the disadvantages, limitations, above-recited, obtained from safety switches.

SUMMARY OF THE INVENTION

It is also the object of this invention to teach a safety switch assembly which is simple to install and use and that will enable the operator to easily operate and will provide optimum efficiency and safety. Particularly, it is the object of this invention to set forth a safety switch assembly, for use with power tools, such as a meat slicer comprising a control housing; said control housing further having an on - off power control switch on said control housing; said control housing further having apparatus control circuit means within said control housing; said control housing further having pneumatic control switch means; handle means; said handle means having air bellows means; said handle means further having safety button means; said handle further having a pneumatic air line; said pneumatic air line having tube means connecting said handle means to said control housing; and said safety button means comprising means for controlling said pneumatic air to flow from said handle means to said pneumatic system switch means in said control housing which in turn permits electrical power to proceed to said power tool plugged into the receptacle on said control housing.

BRIEF DESCRIPTION OF THE DRAWINGS

Further objects and features of this invention will become more apparent by reference to the following description taken in conjunction with the accompanying figure, in which.

DETAILED DESCRIPTION OF THE PREFERRED EMBODIMENT

Figure 1:
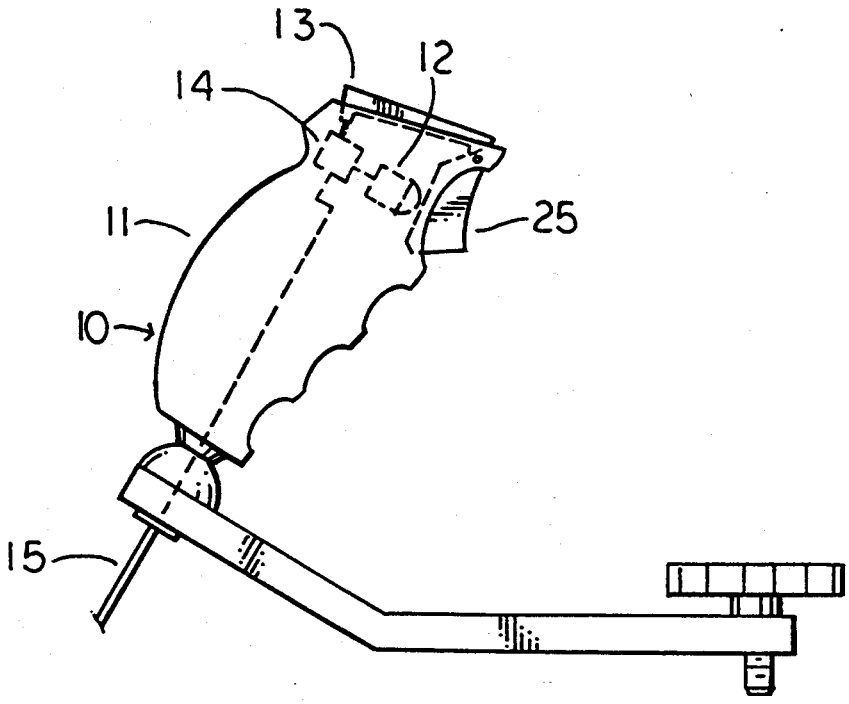
FIG. 1 is a side elevational view of a novel handle means.
Figure 3:
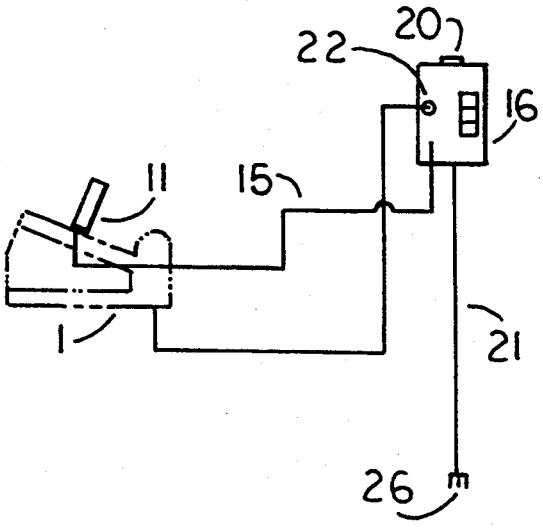
FIG. 3 is a reduced size perspective view of the entire assembly.
Figure 2:
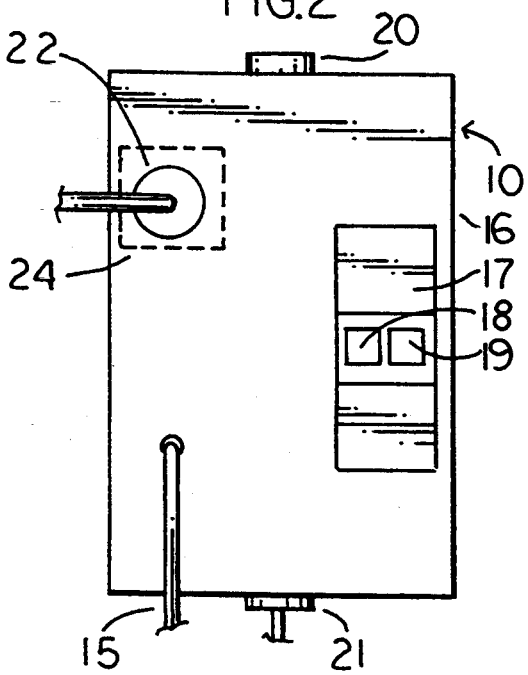
FIG. 2 is a front elevational view of the control box of the novel assembly.
Figure 4:
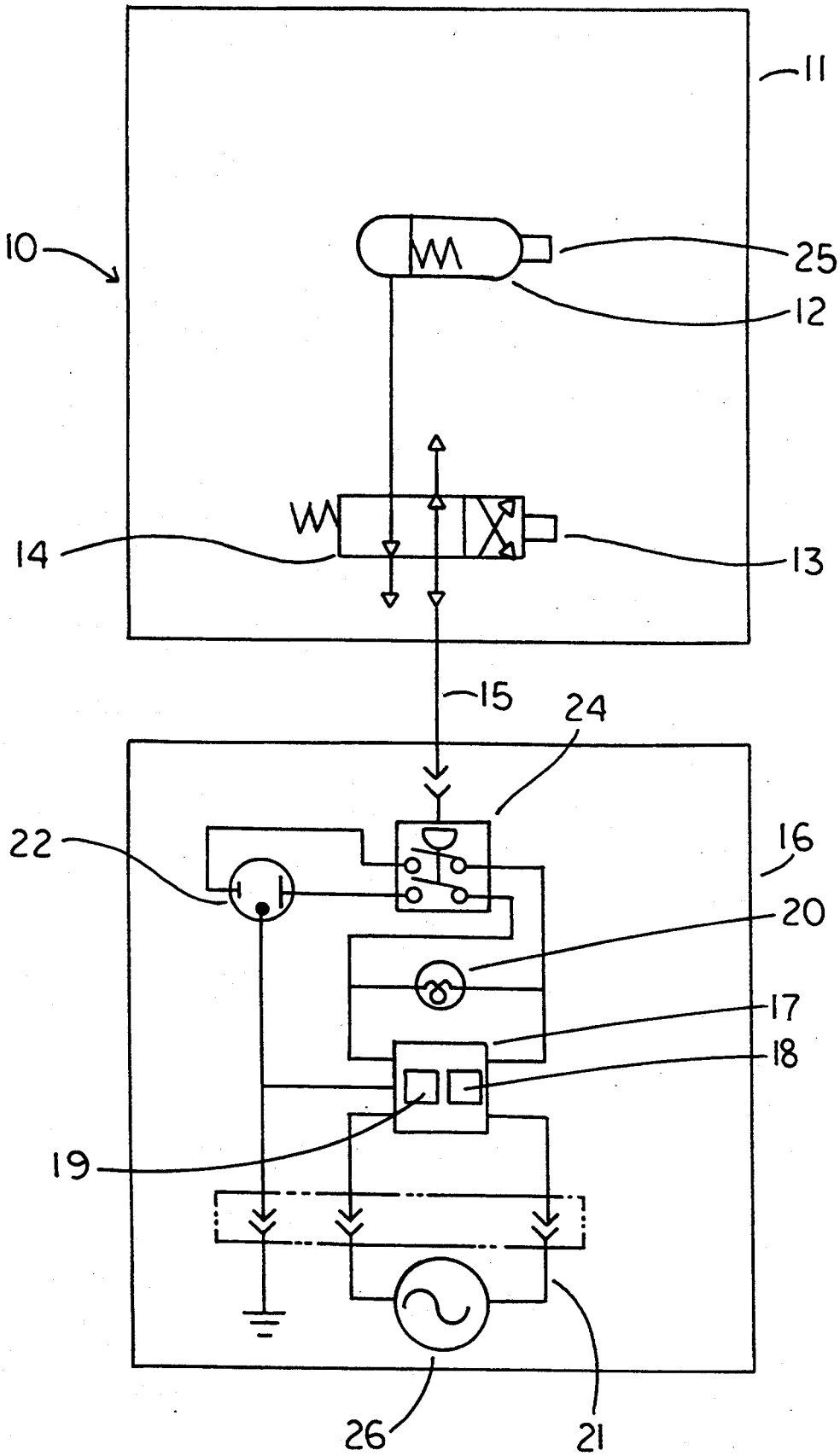
FIG. 4 is a schematic view of the novel circuitry.

As shown in the figures, the novel safety switch assembly 10 is comprised of a handle 11 having a finger trigger 25, bellows 12 and a safety button 13. The finger trigger 25 controls the air bellows 12 to supply pressure to the pneumatic line. The safety button 13 is an interlocking system to control the four way valve 14 which opens when the safety button 13 is depressed and allows air generated by the air bellows to flow in the pneumatic air line 15 to the pneumatic control switch 24. When the button 13 is not depressed the air is vented through valve ports to atmosphere. The other main part of the system is the control box 16 that contains a ground fault circuit interrupter 17 for electrical safety purposes. Additionally, the control box 16 has an interconnected on - off switch 18 and 19, which can be a part of the ground fault interrupter 17, and a signal device 20 which indicates to the operator that the safety switch assembly is ready for operation. It also has a pneumatic control switch 24 and the control circuit. The control box 16 has an incoming power supply line 21 coming in from the power source 26, a power receptacle 22 to power the tool or appliance 1 being operated, and the pneumatic air line 15 coming in from the safety switch handle. When pneumatic air comes through the air line 15 as the finger trigger air bellows 12 and the safety button 13 are depressed, the pneumatic control switch in the control box 16 is closed permitting power to be advanced to the appliance.

Alternate embodiments for the assembly would include the use of an electronic or mechanical brake mechanism which can be used to ensure complete stoppage of the blade as quickly as possible. Also, it would be possible to provide a secondary plate actuator to be positioned in the air line between the handle and the control box. It's purpose is to prevent the flow of air through the line and, thus, the switching on of the power to the device being controlled, if the left hand is not on the secondary plate actuator.

For installation, the tool would be turned off and removed from its power source. The operator would remove the standard old handle from the tool or appliance and screw in or clamp or fasten the safety switch handle. The control box would be mounted on a suitable surface nearby in full view of the operator. The pneumatic air line would be routed from the handle to the front of the control box to be attached to the port for the pneumatic switch that is located within the control box. The control box is plugged into a power source and the plug from the tool or appliance is plugged into the control box receptacle. The on button on the control box is turned on and the signalling device will operate. In operation, the operator is ready to operate and the product is placed upon the slicer, he or she will pull or push the slicer mounted on/off switch and press the safety button and depress the air bellows and begin operations. When the work has been completed, the secondary safety button and the air bellows are released which stops the slicer motor and, at this time, the original on/off switch mounted on the tool is turned off.

While I have described my invention in connection with specific embodiments thereof, it is clearly to be understood that this is done only by way of example and not as a limitation to the scope of my invention as set forth in the objects thereof and in the appended claims.

I claim:

1. A safety switch assembly, for use with power tools, to control operating power to the power tool, comprising:

a control housing;

said control housing having an on - off power control switch positioned on said control housing;

said control housing further having apparatus control circuit means within said control housing;

said control housing further having pneumatic control switch means;

said control housing further having electrical power control means for permitting power to be directed from an electrical source to said power tool;

handle means;

said handle means having air bellows means for providing air pressure;

said handle means further having a trigger mechanism for controlling said air bellows operation;

said handle means further having safety button means;

said handle means further having a pneumatic air line;

said pneumatic air line having tube means connecting said handle means to said control housing; and said safety button means comprising an interlocking system for controlling said pneumatic air to flow from said handle means to said pneumatic control switch means in said control housing which in turn permits electrical power to proceed through said electrical power control means to said power tool.

2. A safety switch assembly, according to claim 1, wherein:

said control housing having ground fault interrupting means.

3. A safety switch assembly, according to claim 1, wherein:

said pneumatic control switch means comprises means for sensing the presence of line pneumatic pressure.

4. A safety switch assembly, according to claim 1, wherein:

said control housing having signalling means; and said signalling means comprising a light that is illuminated when power is available to said control housing.

5. A safety switch assembly, according to claim 1, wherein:

said safety button means comprises an interlocking system for a four port/two way valve for diverting pneumatic flow in said pneumatic line to said pneumatic control switch.

* * * * *